US007546724B2

(12) United States Patent
Wang

(10) Patent No.: US 7,546,724 B2
(45) Date of Patent: Jun. 16, 2009

(54) SPORT RACKET STRINGS WITH HOLLOW CENTER CORE

(75) Inventor: Tsan-Ching Wang, Changhua (TW)

(73) Assignee: Yao I Fabric Co., Ltd., Changhua (TW)

( * ) Notice: Subject to any disclaimer, the term of this patent is extended or adjusted under 35 U.S.C. 154(b) by 660 days.

(21) Appl. No.: 11/194,645

(22) Filed: Aug. 2, 2005

(65) Prior Publication Data

US 2007/0028584 A1 Feb. 8, 2007

(51) Int. Cl.
*D02G 3/22* (2006.01)

(52) U.S. Cl. ..... 57/210

(58) Field of Classification Search ..... 57/210, 57/230, 231, 232, 250, 258
See application file for complete search history.

(56) References Cited

U.S. PATENT DOCUMENTS 3,745,061 A * 7/1973 Champaneria et al. ..... 428/398
4,297,835 A * 11/1981 Shimizu ..... 57/251
4,344,279 A * 8/1982 Ohara ..... 57/232
4,499,144 A * 2/1985 van Rijswijk ..... 428/376
5,327,714 A * 7/1994 Stevens et al. ..... 57/230
6,062,014 A * 5/2000 Yeh ..... 57/232
6,327,841 B1 * 12/2001 Bertini et al. ..... 57/210

* cited by examiner

*Primary Examiner*—Shaun R Hurley
(74) *Attorney, Agent, or Firm*—Rosenberg, Klein & Lee

(57) ABSTRACT

A string for sport rackets includes a center core having at least one first hollow portion extending in an axial direction of the center core and at least one layer wrapped around the center core. The at least one layer is composed of a plurality of first periderm wires which are spirally or alternatively wrapped on the center core.

12 Claims, 8 Drawing Sheets

SPORT RACKET STRINGS WITH HOLLOW CENTER CORE

FIELD OF THE INVENTION

The present invention relates to a string structure for sport rackets and the strings include a hollow center core and a plurality of periderm wires spirally wrapped around the center core.

BACKGROUND OF THE INVENTION

The conventional sport rackets generally include a frame with a netted portion and a handle connected to the handle. The netted portion is composed of strings which can be Nylon strings, synthetic gut strings, or nature gut strings. The Nylon strings are durable but have less flexibility and are affected by changes of temperature. The nature gut intestine strings have better flexibility but are less stronger than the Nylon strings and synthetic gut strings. The conventional sport rackets are focused on the area of sweet spot which is an area on the netted portion and the players can ideally respond the balls that hit the sweet spot.

A conventional string structure is composed of periderm wires and a metal wire of predetermined length. The periderm wires and the metal wire are wrapped together along an axial direction. There is no center core for the string. Another conventional string includes a center core with periderm wires and the metal wire is wrapped along the center core. The periderm wires and the metal wire have different physical properties such as coefficient of extension. They provide flexibility and the metal wire reinforces the structural strength of the strings. However, these two conventional strings need to be improved in flexibility, durability, aid energy return coefficient.

The present invention provides a string structure that includes a hollow center core and periderm wires wrapped about a center core.

SUMMARY OF THE INVENTION

The present invention relates to a string for sport rackets and the string comprises a center core having at least one hollow portion extending in an axial direction of the center core. An outer layer comprising of a plurality of first periderm wires is provided around the center core.

A primary object of the present invention is to provide a string for sport rackets which absorbs shock effectively and provide better flexibility in response to a balls hitting a strung portion of the sport rackets.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
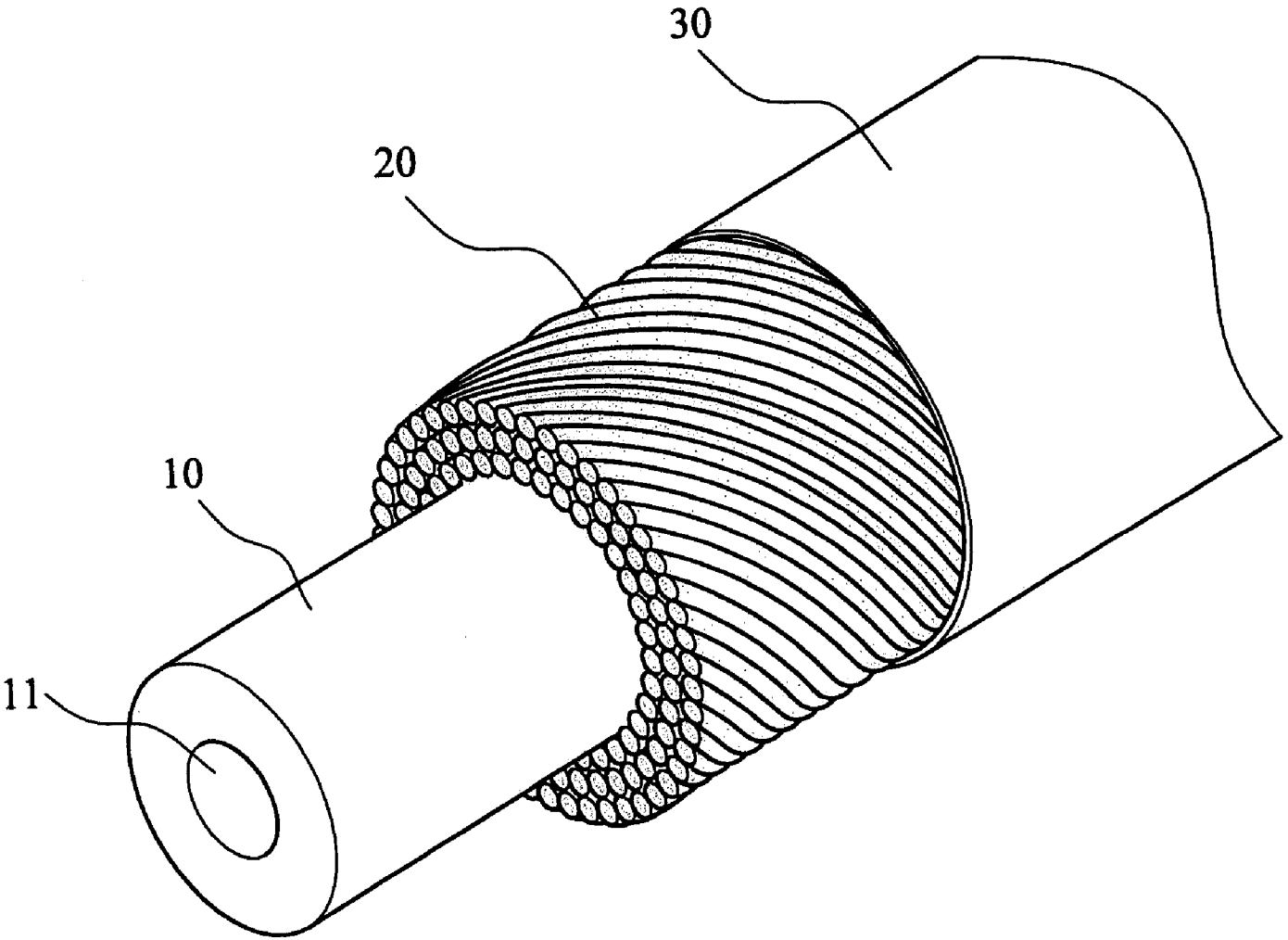
FIG. 1 shows a first embodiment of the string of the present invention.

Referring to FIG. 1, one embodiment of the string of the present invention comprises a center core 10 having at least one first hollow portion 11 which extends in an axial direction of the center core 10. The at least one first hollow portion 11 is a circular passage defined axially in the center core 10. A first outer layer comprising a plurality of first periderm wires 20 is wrapped about the center core 10. The first periderm wires 20 of the first outer layer are spirally wrapped about the center core 10. A coat layer 30 is wrapped on the first outer layer. It is noted that the first periderm wires 20 of the first outer layer may also be alternatively wrapped in non-spiral manner about the center core 10.

Figure 2:
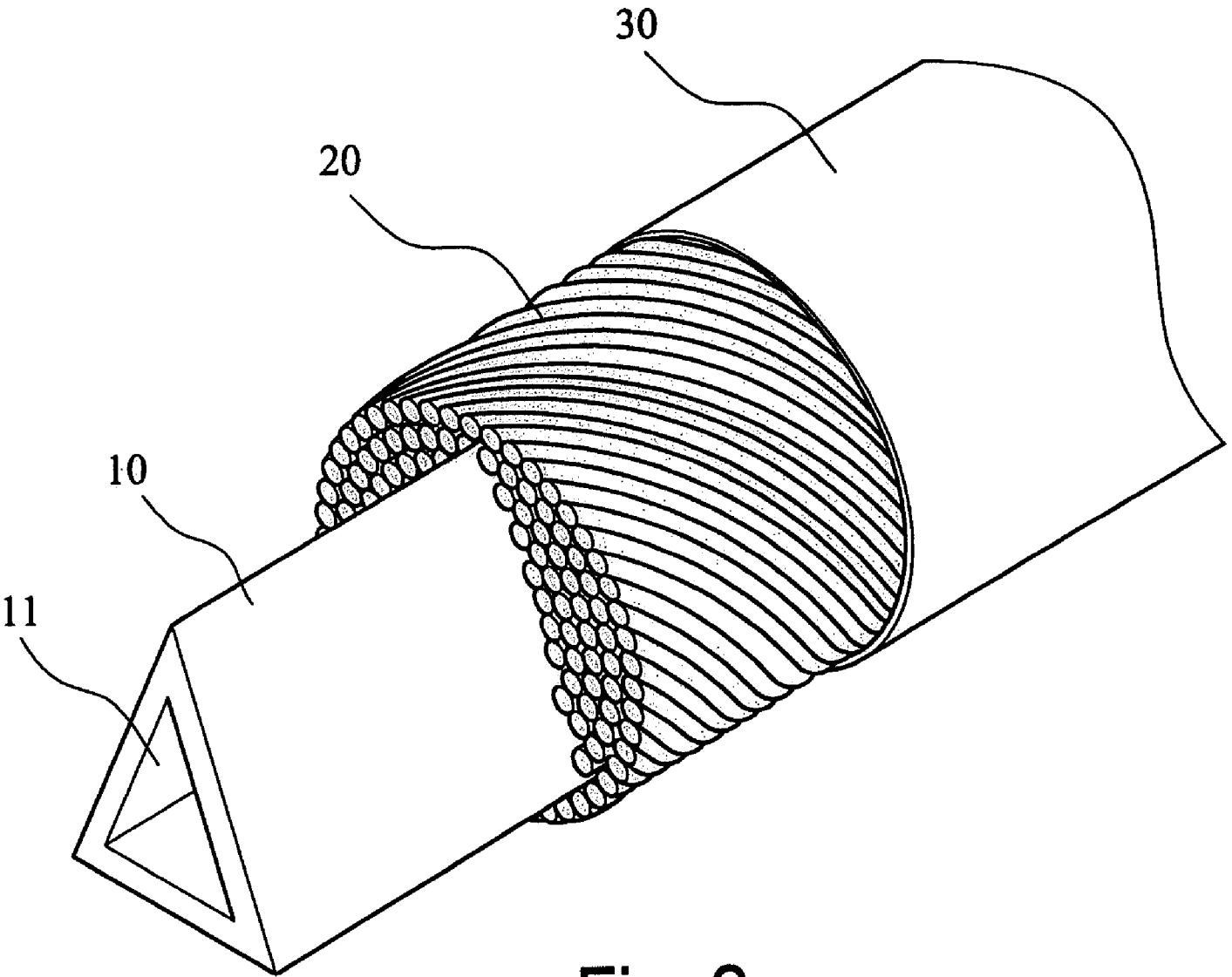
FIG. 2 shows a second embodiment of the string of the present invention.

As disclosed in FIG. 2, the at least one first hollow portion 11 may be a triangle passage defined axially in the center core 10.

Figure 3:
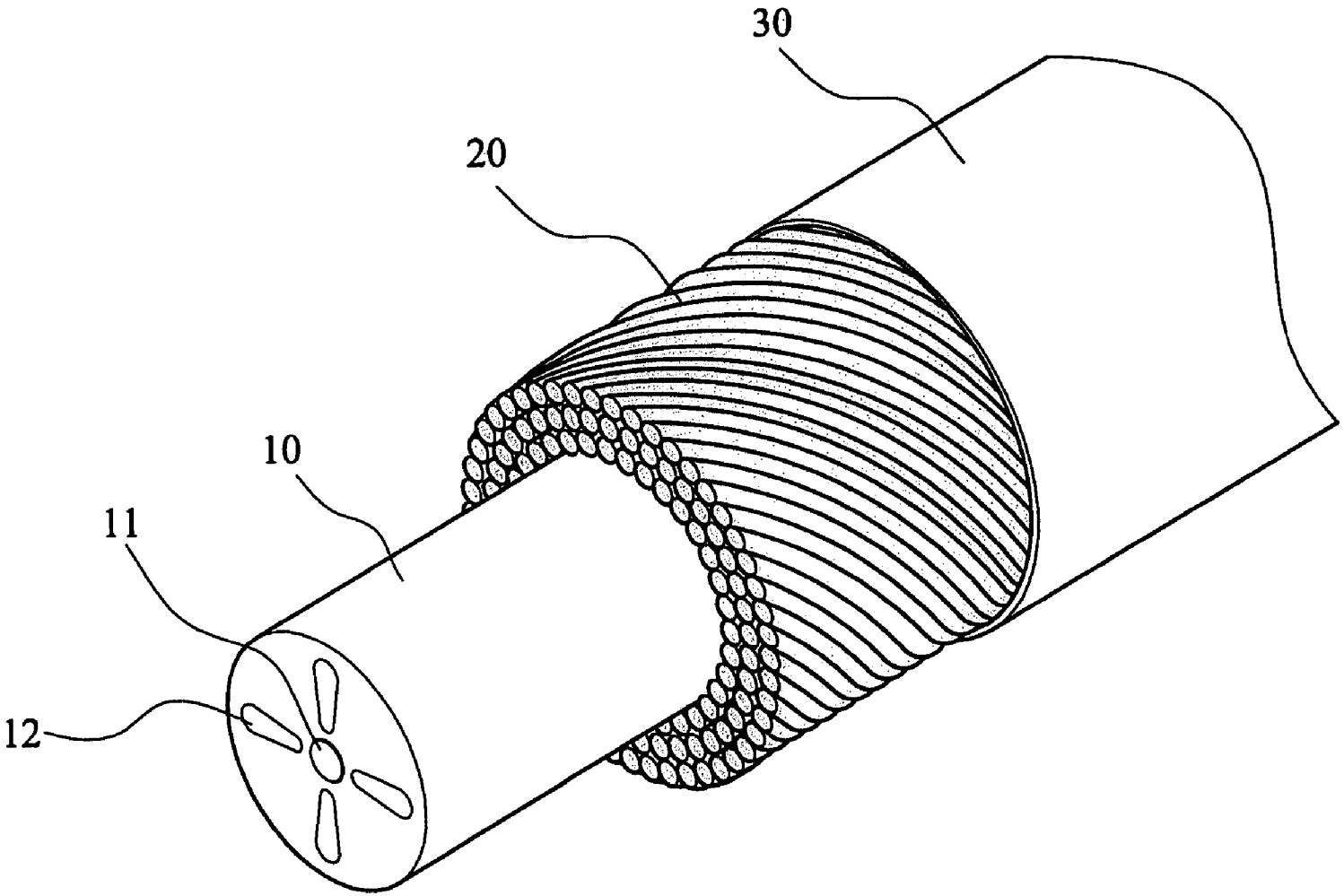
FIG. 3 shows a third embodiment of the string of the present invention.

Referring to FIG. 3, the center core 10 may further have at least one second hollow portion 12 defined radially in the center core 10. In this embodiment, the number of the second hollow portions 12 is four.

Figure 4:
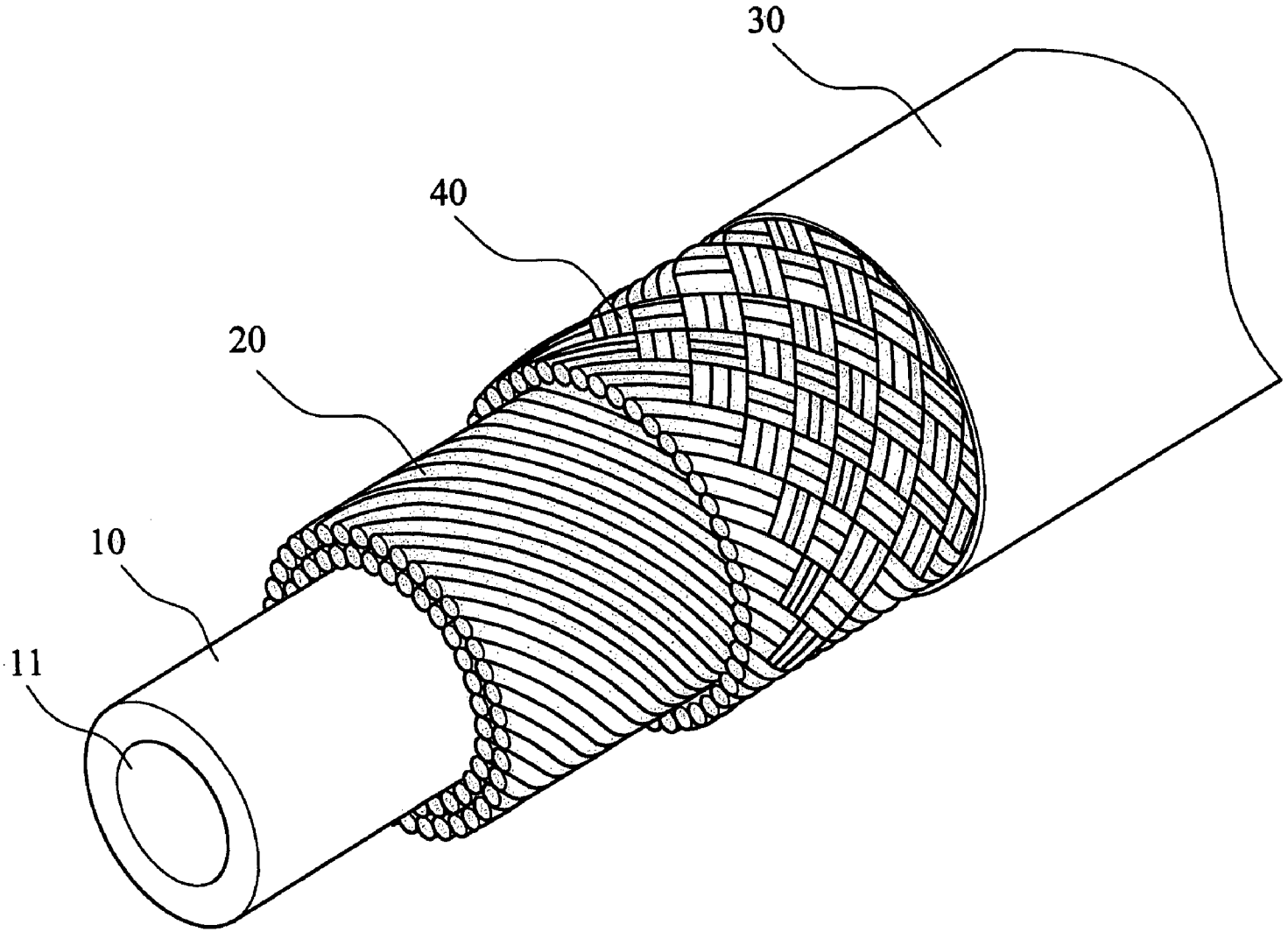
FIG. 4 shows a fourth embodiment of the string of the present invention.

FIG. 4 shows that the string may further have a second outer layer comprising a plurality of second periderm wires 40. The first outer layer is encompassed by the second outer layer. The second periderm wires 40 of the second outer layer are alternatively wrapped or spirally wrapped about the first outer layer. The coat layer 30 is wrapped on the second outer layer.

Figure 5:
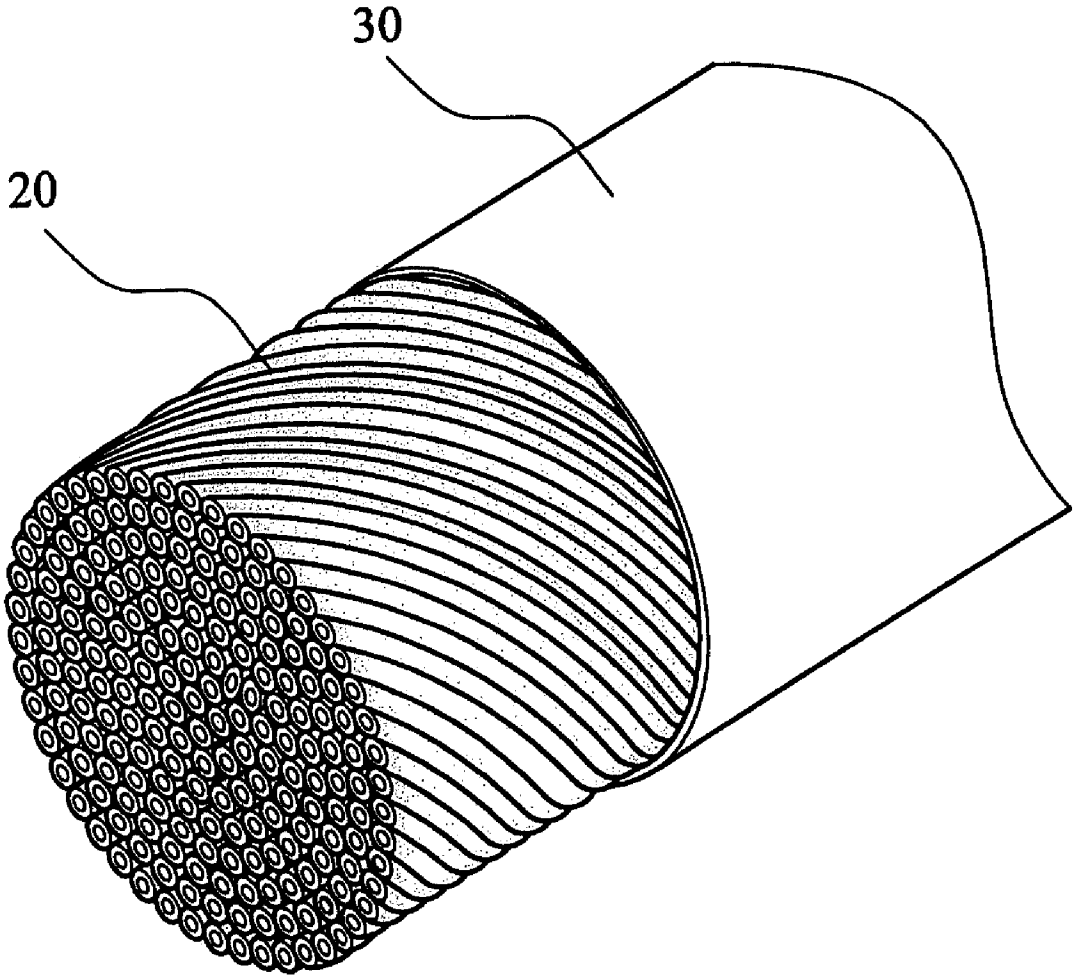
FIG. 5 shows a fifth embodiment of the string of the present invention.

As shown in FIG. 5, the string may also be made by a plurality of center cores 10 bundled as a string of wires 20 as illustrated, with each of the center cores 10 having at least one first hollow portion 11 extending axially therethrough. A coat layer 30 is wrapped on the bundle of the center cores 10.

The first and second hollow portions 11, 12 of the center cores 10 provide sport rackets with more flexibility by virtue of the air in the hollow portions 11, 12. Consequently, excessive shock may be absorbed by deformation of the center cores 10. The first and second hollow portions 11, 12 of the center cores 10 reduce the energy transferred to players' hands so as to protect the muscles and wrists of the players from injury. Furthermore, the embodiment disclosed in FIG. 5 provides maximum flexibility so that the balls hitting the given racket may be shot back at high speed.

Figure 6:
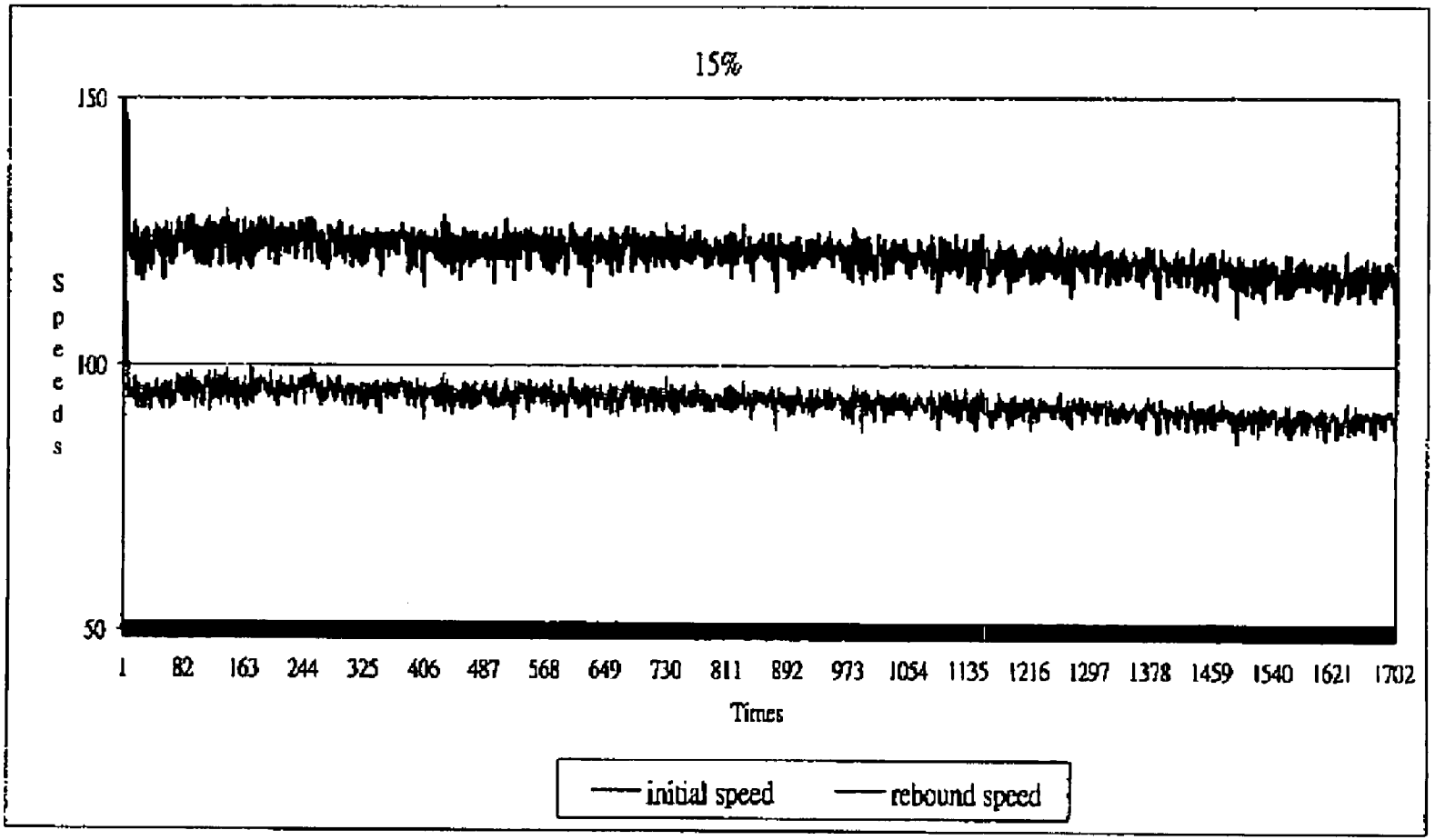
FIG. 6 shows test details for strings of the present invention with 15% hollow ratio.
Figure 7:
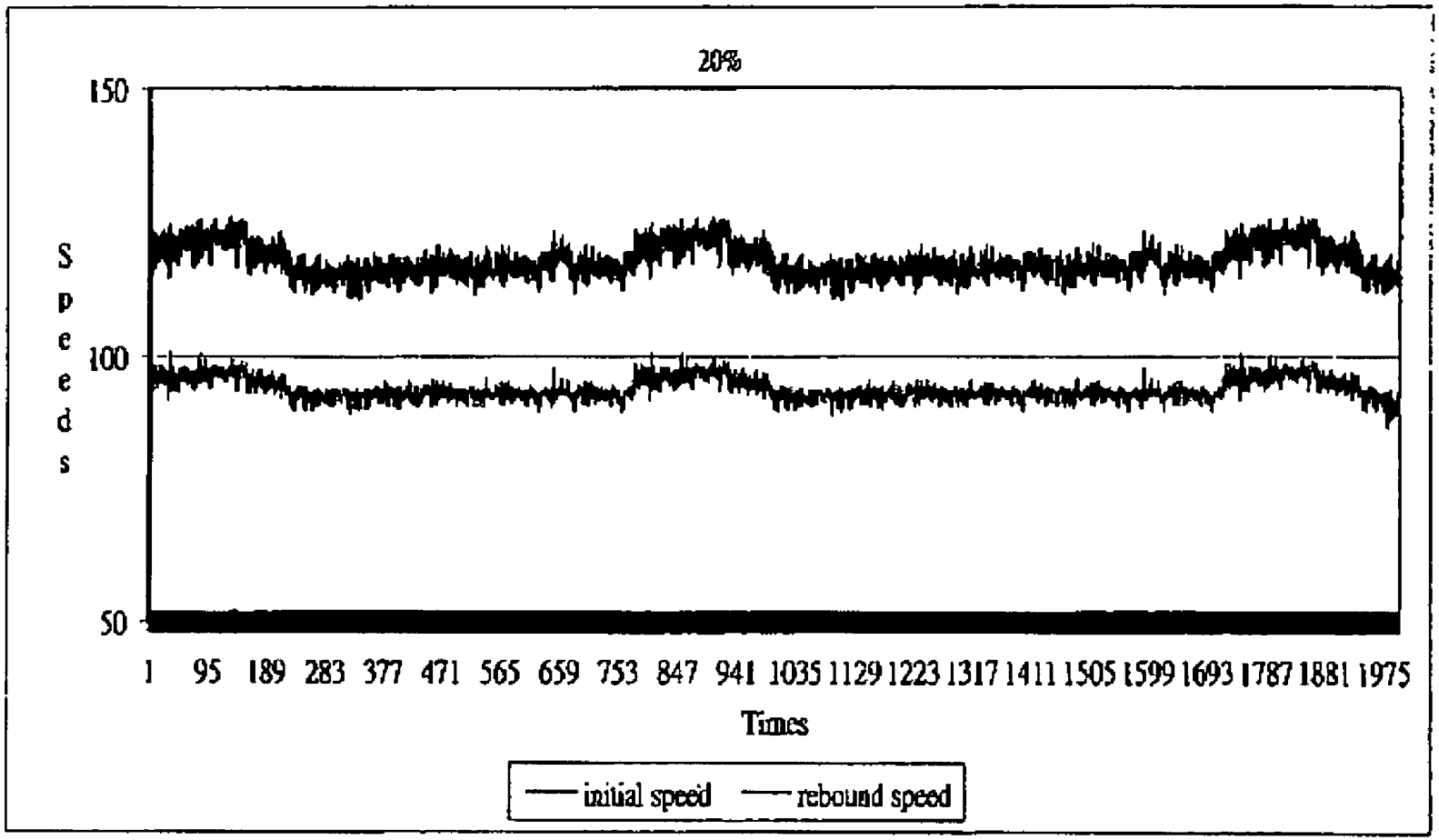
FIG. 7 shows test details for strings of the present invention with 20% hollow ratio; and, FIG. 8 shows the test details for conventional nylon strings.
Figure 8:
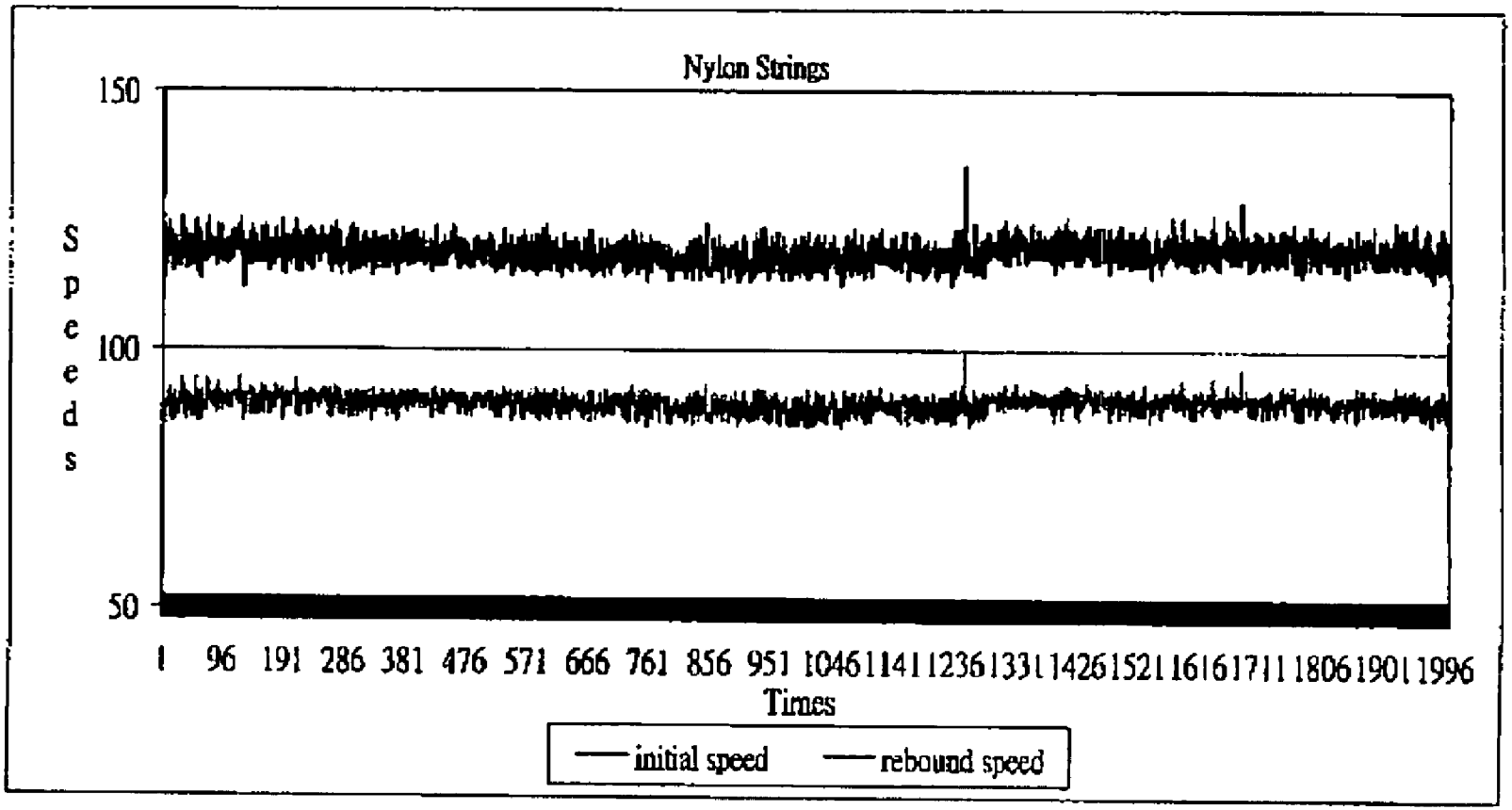

As shown in FIGS. 6-8, which show the initial speed and rebound speed of the tennis balls hitting the strings of different hollow ratio installed on a sport racket. The tennis balls were served at 125 km/hr at, respectively, at a hitting surface formed by strings formed in accordance with embodiments of the present invention as compared to a hitting surface formed by Nylon tennis strings. FIG. 6 shows the case using the strings of the present invention with 15% hollow ratio, and FIG. 7 shows the case using the strings of the present invention with 20% hollow ratio, and FIG. 8 shows the case using the original Nylon strings. Each diagram includes an upper curve which shows the initial speed of the tennis balls and a lower curve which shows the rebound speed of the balls. Although tennis strings are developed to a mature level, the present invention achieves improvements over existing tennis strings, as reflected by the details shown below.

| Item | 15% hollow ratio | 20% hollow ratio | Nylon String |
|---|---|---|---|
| Hollow ratio | 15% | 20% | 0 |
| Dimensions (mm) | 1.3 | 1.3 | 1.3 |
| Times | 2000 | 2000 | 2000 |
| Energy return Average (%) | 77.09 | 79.46 | 75.73 |

*Energy return Average defined by rebound speed/initial speed (125 km/hr)

While we have shown and described the embodiment in accordance with the present invention, it should be clear to those skilled in the art that further embodiments may be made without departing from the scope of the present invention.

What is claimed is:

1. A string for sport rackets, comprising:

an axially extended center core having a uniform sectional contour therealong, the center core having at least one first hollow portion extending axially therethrough, the first hollow portion extending in unfilled and radially enclosed manner within the center core; and, a first outer layer including a plurality of first periderm wires wrapped about the center core.

2. The string device as claimed in claim 1, wherein the first periderm wires of the first outer layer are spirally wrapped around the center core.

3. The string as claimed in claim 1, comprising a plurality of outer layers of periderm wires, wherein the periderm wires of at least one of the outer layers are non-spirally wrapped around the center core.

4. The string as claimed in claim 1, wherein the at least one first hollow portion is a passage defined coaxially through the center core.

5. The string as claimed in claim 1 further comprising at least one second hollow portion radially offset from the first hollow core in the center core.

6. The string as claimed in claim 1, wherein the at least one first hollow portion is a triangle passage defined axially in the center core.

7. The string as claimed in claim 1 further comprising a second outer layer composed of a plurality of second periderm wires, the first outer layer being encompassed by the second outer layer.

8. The string device as claimed in claim 7, wherein the second periderm wires 40 of the second outer layer are spirally wrapped about the first outer layer.

9. The string as claimed in claim 7, wherein the second periderm wires of the second outer layer are non-spirally wrapped about the first outer layer.

10. The string device as claimed in claim 1, wherein a coat layer is wrapped on the first outer layer.

11. The string device as claimed in claim 7, wherein a coat layer is wrapped on the second outer layer.

12. A string for sport rackets, comprising:

a plurality of wires bundled as a string and each of the wires having a uniform sectional contour and defining at least one first hollow portion extending axially therethrough, the first hollow portion extending in unfilled and radially enclosed manner within each of the wires; and, a coat layer wrapped on the bundle of the wires.

* * * * *